US008029125B2

(12) United States Patent
Derimiggio et al.

(10) Patent No.: US 8,029,125 B2
(45) Date of Patent: Oct. 4, 2011

(54) VARIABLE RATE FLUID FILM RELEASE IN AN INK JET PRINTER

(75) Inventors: John E Derimiggio, Fairport, NY (US); Paul M Fromm, Rochester, NY (US); David P Van Bortel, Victor, NY (US)

(73) Assignee: Xerox Corporation, Norwalk, CT (US)

( * ) Notice: Subject to any disclaimer, the term of this patent is extended or adjusted under 35 U.S.C. 154(b) by 580 days.

(21) Appl. No.: 12/243,576

(22) Filed: Oct. 1, 2008

(65) Prior Publication Data

US 2010/0079561 A1 Apr. 1, 2010

(51) Int. Cl.
*B41J 2/175* (2006.01)

(52) U.S. Cl. ..... 347/103

(58) Field of Classification Search ..... 347/103, 347/84, 85

See application file for complete search history.

(56) References Cited

U.S. PATENT DOCUMENTS 3,647,525 A * 3/1972 Dahlgren ..... 427/428.15
3,937,141 A * 2/1976 Dahlgren ..... 101/148
4,041,864 A * 8/1977 Dahlgren et al. ..... 101/350.4
7,840,170 B2 * 11/2010 Williamson et al. ..... 399/325
2008/0037069 A1 2/2008 Mestha et al.
2010/0066792 A1 * 3/2010 Williamson et al. ..... 347/103

* cited by examiner

*Primary Examiner* — Huan Tran
(74) *Attorney, Agent, or Firm* — Ronald E. Prass, Jr.; Prass LLP

(57) ABSTRACT

An apparatus for ink jet printing, as well as corresponding method and system are described. The apparatus includes a source of fluid film, a fluid film metering roller supported for contact with the source of fluid film, a variable speed drive arranged to effect movement of the fluid film metering roller in an endless path at different surface velocities, a donor roller supported in contact with the fluid film metering roller, an ink jet printhead configured to emit ink, and a print assembly rotatably supported in the apparatus, the print assembly having a print assembly surface coupled to the donor roller, the print assembly configured to receive ink from the ink jet printhead and produce an image on media using the ink, wherein the donor roller is configured to convey the fluid film from the fluid film metering roller to the print assembly surface at various rates depending on a surface velocity of the fluid film metering roller, and at least one of the following: an amount of fluid film left on the donor roller, a film thickness of the fluid film on the fluid film metering roller, and a speed ratio between the fluid film metering roller and the donor roller, wherein the variable speed drive is operative independently of the print assembly.

20 Claims, 4 Drawing Sheets

VARIABLE RATE FLUID FILM RELEASE IN AN INK JET PRINTER

RELATED APPLICATIONS

This application is related to the application Ser. No. 12/243,380 entitled "Variable Rate Fuser Release Fluid Application", which is filed on the same date as the present application, which is commonly assigned to the assignee of the present application, and which is incorporated herein by reference in its entirety.

BACKGROUND

The present disclosure relates generally to fluid film release in imaging systems. More particularly, the present disclosure describes an apparatus, method, and system useful for providing variable rate fluid film release in ink jet imaging systems.

The fluid film release rate may be an important parameter for ink jet operation. Normally, ink jet fluid applicators are designed for a nominal rate that is not easily adjusted or tuned. As a result, ink jet fluid applicators are vulnerable to release fluid rate variability due to part variations and wear as well as effects of different media. Moreover, given media and/or job type, there is an optimum release fluid rate, but for fixed rate release fluid application systems, the rate has to be chosen so that the most demanding job within the operating specifications receives sufficient release film fluid. Consequently, many other job types will get more release film fluid, such as silicone oil, than is needed, which often contributes to secondary negative effects, such as prints getting oily and/or objects failing to stick to the paper and/or excess oil getting spread to other components when duplexing, for example.

SUMMARY

According to various illustrative embodiments, an apparatus for ink jet printing, as well as corresponding method and system for are described. The apparatus includes a source of fluid film, a fluid film metering roller supported for contact with the source of fluid film, a variable speed drive arranged to effect movement of the fluid film metering roller in an endless path at different surface velocities, a donor roller supported in contact with the fluid film metering roller, an ink jet printhead configured to emit ink, and a print assembly rotatably supported in the apparatus, the print assembly having a print assembly surface coupled to the donor roller, the print assembly configured to receive ink from the ink jet printhead and produce an image on media using the ink, wherein the donor roller is configured to convey the fluid film from the fluid film metering roller to the print assembly surface at various rates depending on a surface velocity of the fluid film metering roller, and at least one of the following: an amount of fluid film left on the donor roller, a film thickness of the fluid film on the fluid film metering roller, and a speed ratio between the fluid film metering roller and the donor roller, wherein the variable speed drive is operative independently of the print assembly.

BRIEF DESCRIPTION OF THE DRAWINGS

The following figures form part of the present specification and are included to further demonstrate certain aspects of the disclosed features and functions, and should not be used to limit or define the disclosed features and functions. Consequently, a more complete understanding of the present embodiments and further features and advantages thereof may be acquired by referring to the following description taken in conjunction with the accompanying drawings, wherein.

Figure 1:
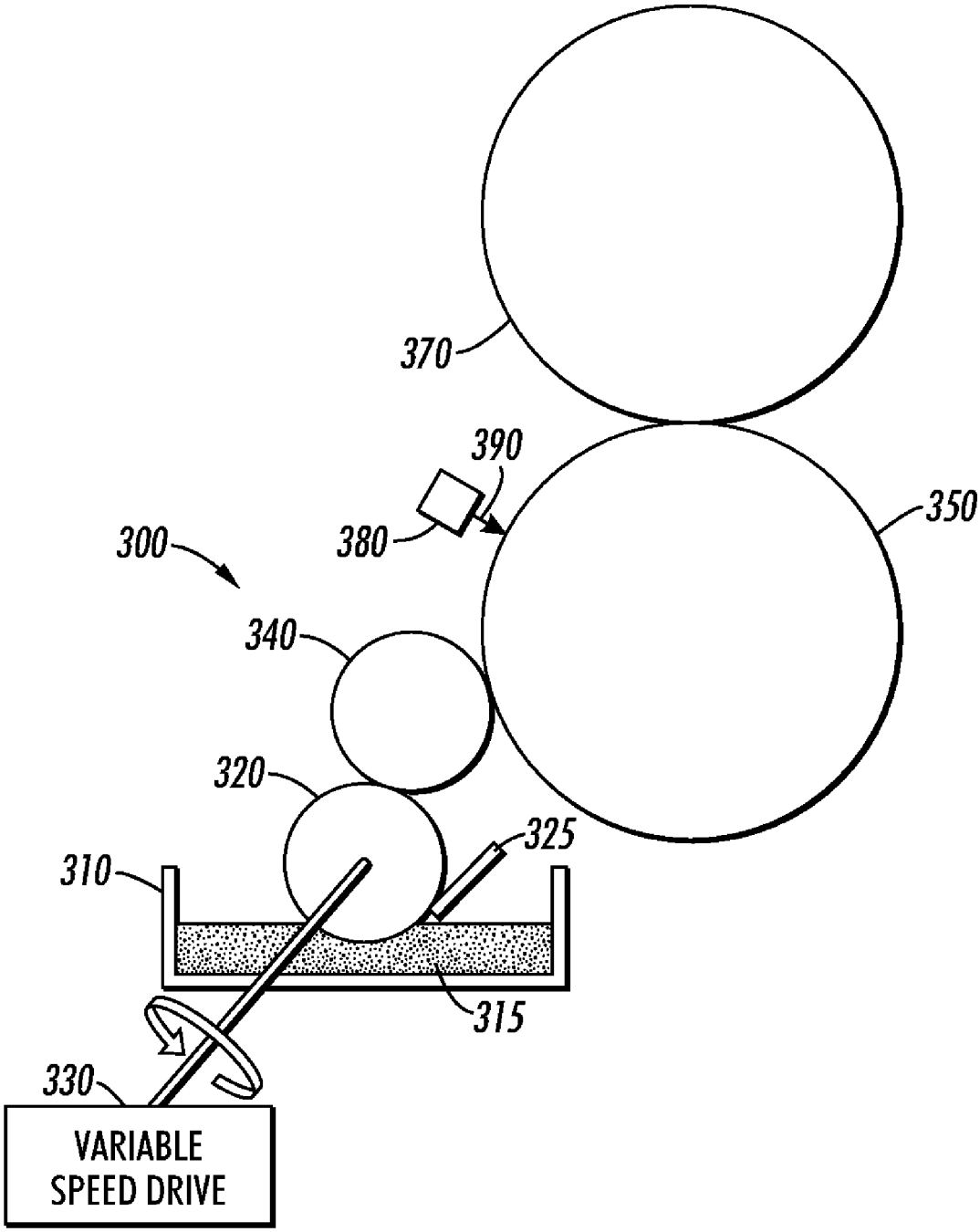
FIG. 1 schematically illustrates a particular example of various illustrative embodiments of an apparatus in accord with the present disclosure.

It is to be noted, however, that the appended drawings illustrate only typical embodiments of the disclosed subject matter and are, therefore, not to be considered limiting of the scope of the disclosed subject matter, as the disclosed subject matter may admit to other equally effective embodiments.

DETAILED DESCRIPTION

Illustrative embodiments are described in detail below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of the present disclosure.

Embodiments include an apparatus useful in ink jet printing. The apparatus includes a source of fluid film, a fluid film metering roller supported for contact with the source of fluid film, a variable speed drive arranged to effect movement of the fluid film metering roller in an endless path at different surface velocities, a donor roller supported in contact with the fluid film metering roller, an ink jet printhead configured to emit ink, and a print assembly rotatably supported in the apparatus, the print assembly having a print assembly surface coupled to the donor roller, the print assembly configured to receive ink from the ink jet printhead and produce an image on media using the ink, wherein the donor roller is configured to convey the fluid film from the fluid film metering roller to the print assembly surface at various rates depending on a surface velocity of the fluid film metering roller, and at least one of the following: an amount of fluid film left on the donor roller, a film thickness of the fluid film on the fluid film metering roller, and a speed ratio between the fluid film metering roller and the donor roller, wherein the variable speed drive is operative independently of the print assembly.

Embodiments also include a method for variable rate fluid film application in an ink jet printer. The method includes supporting a fluid film metering roller for contact with a supply of fluid film, arranging a variable speed drive to effect movement of the fluid film metering roller in an endless path at different surface velocities, and supporting a donor roll in contact with the fluid film metering roller and a print assembly, the donor roller arranged to convey the fluid film from the fluid film metering roller to the print assembly at various rates depending on a surface velocity of the fluid film metering roller, and at least one of the following: an amount of fluid film left on the donor roller, a film thickness of the fluid film on the fluid film metering roller, and a speed ratio between the fluid film metering roller and the donor roller, wherein the variable speed drive is operative independently of the print assembly.

Embodiments further include a system for variable rate fluid film application in an ink jet printer, the system including a fluid film metering roller supported for contact with a supply of fluid film, a variable speed drive arranged to effect movement of the fluid film metering roller in an endless path at different surface velocities, a donor roller supported in contact with the fluid film metering roller and a print assembly, the donor roller arranged to convey fluid film from the fluid film metering roller to the printer assembly at various rates depending on a surface velocity of the fluid film metering roller, and at least one of the following: an amount of fluid film left on the donor roller, a film thickness of fluid film on the fluid film metering roller, and a speed ratio between the fluid film metering roller and the donor roller, wherein the variable speed drive is operative independently of the print assembly, and an ink jet printhead configured to emit ink to the print assembly.

In various illustrative embodiments, as shown in FIG. 1, for example, an apparatus 300 for variable rate fluid film application in an ink jet printing system may include a supply 310 of fluid film 315. The apparatus 300 may be a printer, a multifunction media device, an ink jet printer, or any other device that produces an ink image on media. The fluid film can be a release agent, a lubricant, an ink, a thin film, oil, silicon oil, or any other liquid. A release agent can minimize toner offset on a print assembly, can provide for separation of media from the print assembly, and can provide other release agent properties. The apparatus 300 may also include a fluid film metering roller 320 supported for contact with the supply 310 of the fluid film 315. The apparatus 300 may also include a variable speed drive 330 arranged to effect movement of the fluid film metering roller 320 in an endless path at different surface velocities. In various illustrative embodiments, the variable speed drive 330 may be a motor or variable ratio transmission. The apparatus 300 may also include a donor roller 340 supported in contact with the fluid film metering roller 320 and a print assembly 350 in contact with pressure roller 370, the donor roller 340 arranged to convey fluid film 315 from the fluid film metering roller 320 to the print assembly 350 at various rates depending on a surface velocity of the fluid film metering roller 320, and at least one of the following items: an amount of fluid film 315 left on the donor roller 340, a film thickness of fluid film 315 on the fluid film metering roller 320, and a speed ratio between the fluid film metering roller 320 and the donor roller 340, wherein the variable speed drive 330 is operative independently of the print assembly 350. The apparatus 300 can include an ink jet printhead 380 configured to emit ink 390 to the print assembly 350.

In various illustrative embodiments, the donor roller 340 may be elastomer covered. In various illustrative embodiments, the donor roller 340 may be driven by the print assembly 350. In various illustrative embodiments, the donor roller 340 may slip relative to the fluid film metering roller 320. In various illustrative embodiments, the fluid film metering roller 320 may include a metal having a ground, extruded, molded, or turned surface. In various other illustrative embodiments, the fluid film metering roller 320 may include plastic, aluminum, ceramic or other material having a ground, extruded, molded, or turned surface.

In various illustrative embodiments, the fluid film 315 may be picked up from the supply 310 by the fluid film metering roller 320 and then the film thickness of the fluid film 315 may be lowered by a contacting doctor or metering blade 325, as shown in FIG. 1, for example. The fluid film 315 may then be transferred nip to nip until a thin film of the fluid film 315 may be applied to the print assembly 350. The amount of the fluid film 315 that may be applied to the print assembly 350 may depend on the film thickness of the fluid film 315 between the fluid film metering roller 320 and the donor roller 340. If the fluid film metering roller 320 rotational speed is controlled independently of the rotational speed of the donor roller 340, then the film thickness of the fluid film material 315 between the fluid film metering roller 320 and the donor roller 340 may be varied. Varying the film thickness of the fluid film 315 between the fluid film metering roller 320 and the donor roller 340 will vary the amount of the fluid film 315 that may be applied to the print assembly 350.

In various illustrative embodiments, if the rotational speed of the fluid film metering roller 320 is very low, at least two effects will combine to lower the amount of the fluid film 315 that is delivered to the print assembly 350. One effect is that the film thickness of the fluid film 315 left on the fluid film metering roller 320 after the doctor blade 325 will decrease as the rotational speed decreases due to lubrication theory. Another effect is that the rate of transporting the film thickness of the fluid film 315 on the fluid film metering roller 320 to the donor roller 340 is reduced. As the fluid film metering roller 320 rotational speed is increased, the film thickness of the fluid film 315 on the fluid film metering roller 320 will increase and the rate of presenting this film of the fluid film 315 to the donor roller 340 increases. As a result, the rate of the application of the fluid film 315 to the printer assembly 350 may be substantially continuously adjustable and variable.

In various illustrative embodiments, the fluid film metering roller 320 may be driven by the variable speed drive 330 at an independently controlled rotational speed. By doing so, the relative motion between the donor roller 340, which may be driven by friction with the print assembly 350, and the fluid film metering roller 320 may be varied. As the rotational speeds vary, the sheer plane within the fluid film material 315 layer between the fluid film metering roller 320 and the donor roller 340 changes as well as the overall amount of the fluid film 315 being pulled from the supply 310 by the fluid film metering roller 320. This results in an adjustable amount of fluid film 315 being applied to the print assembly 350.

Figure 2:
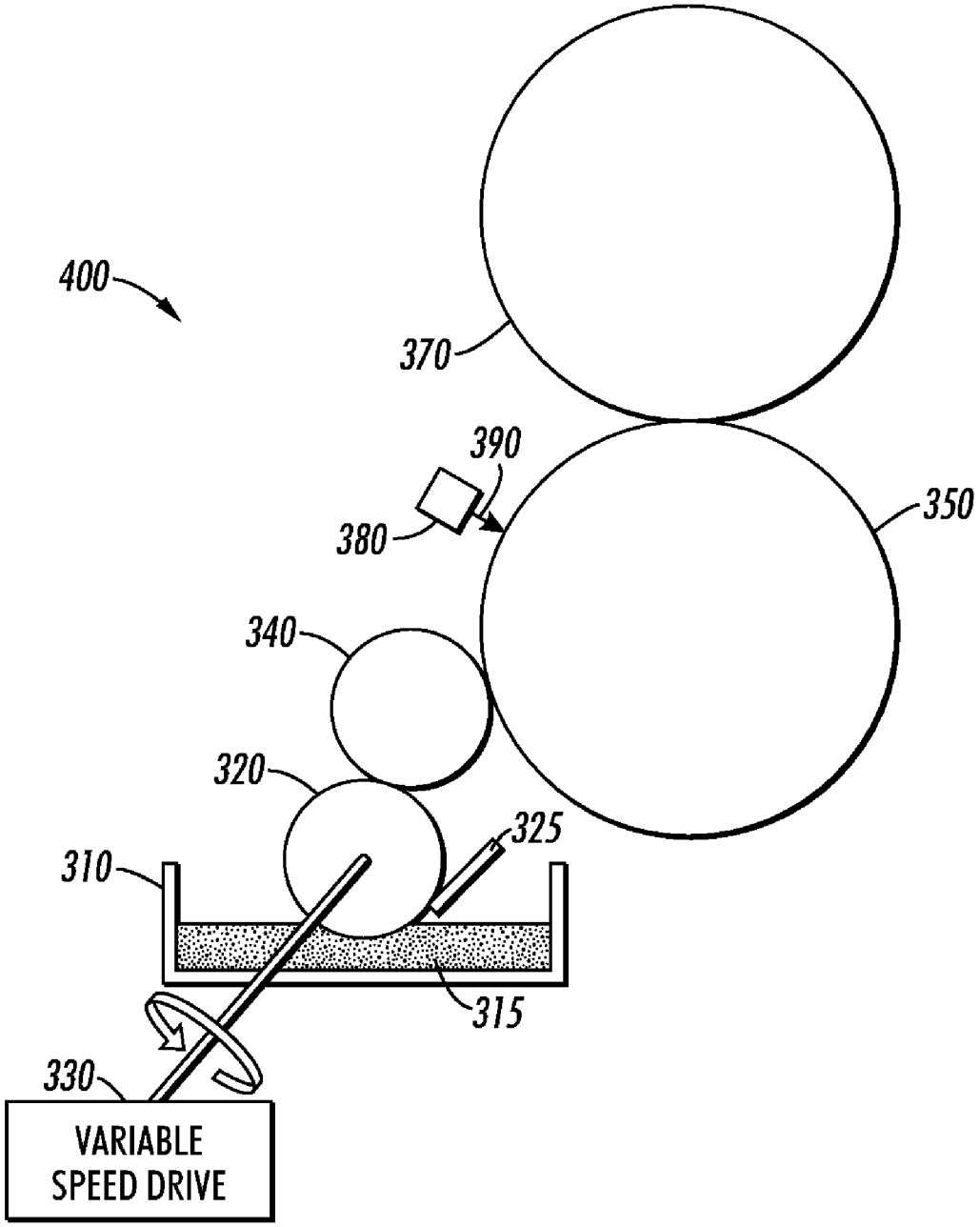
FIG. 2 schematically illustrates a particular example of various illustrative embodiments of an apparatus in accord with the present disclosure.

In various illustrative embodiments, as shown in FIG. 2, for example, a system 400 for variable rate fluid film application may include the supply 310 of the fluid film material 315. The system 400 may also include the fluid film metering roller 320 supported for contact with the supply 310 of the fluid film 315. The system 400 may also include the variable speed drive 330 arranged to effect movement of the fluid film metering roller 320 in an endless path at different surface velocities. In various illustrative embodiments, the variable speed drive 330 may be a motor or variable ratio transmission. The system 400 may also include the donor roller 340 supported in contact with the fluid film metering roller 320 and the print assembly 350, the donor roller 340 arranged to convey fluid film 315 from fluid film metering roller 320 to the print assembly 350 at various rates depending on the surface velocity of the fluid film metering roller 320, and at least one of the following items: an amount of fluid film 315 left on the donor roller 340, the film thickness of fluid film 315 on the fluid film metering roller 320, and the speed ratio between the fluid film metering roller 320 and the donor roller 340, wherein the variable speed drive 330 is operative independently of the print assembly 350. The system 400 may also include a pressure roller 370, the pressure roller 370 supported in contact with the print assembly 350.

Figure 3:
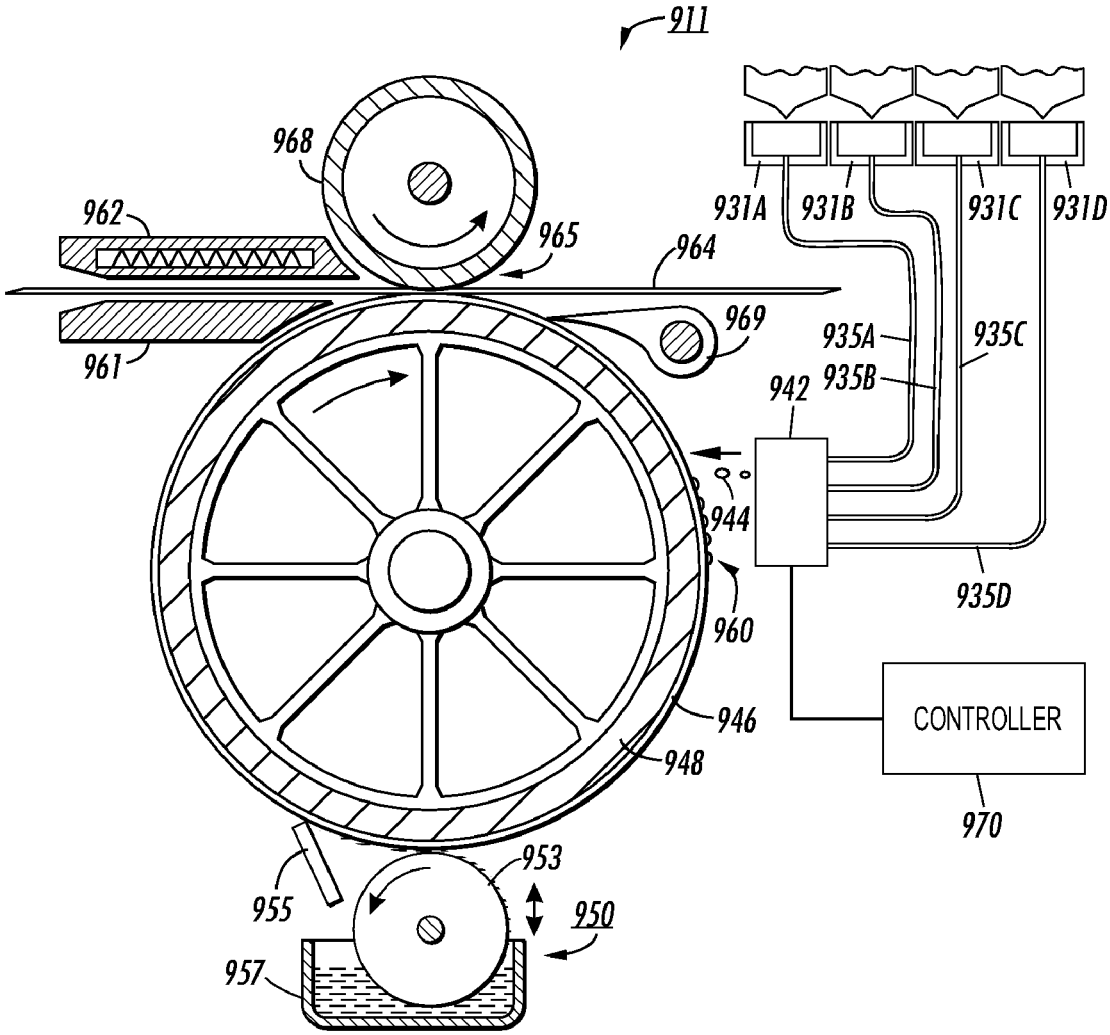
FIG. 3 schematically illustrates a particular example of various illustrative embodiments of an apparatus in accord with the present disclosure.

FIG. 3 illustrates a diagram of an embodiment of an ink jet printing mechanism 911 that can include or be part of the apparatus 300. The printing mechanism 911 can include a printhead 942 that is appropriately supported for stationary or moving utilization to emit drops 944 of ink onto an intermediate transfer surface 946 applied to a supporting surface of a print drum 948. The print drum 948 can be the print assembly 350 of the apparatus 300. The ink is supplied from the ink reservoirs 931A, 931B, 931C, and 931D of the ink supply system through liquid ink conduits 935A, 935B, 935C, and 935D that connect the ink reservoirs 931A, 931B, 931C, and 931D with the printhead 942. The intermediate transfer surface 946 can be a fluid film, such as a functional oil, that can be applied by contact with an applicator such as a roller 953 of an applicator assembly 950. By way of illustrative example, the applicator assembly 950 can include a metering blade 955 and a reservoir 957. The applicator assembly 950 can be configured for selective engagement with the print drum 948. The applicator assembly 950 can use the donor roller 140 between the roller 953 and the print drum 948 in a similar manner to how the donor roller 140 is used between the source of fluid film 310 and the print assembly 350, as well as the variable speed drive 330 connected to the roller 953. In the illustrative embodiment, the print drum 948 can operate in two rotation cycles where, in a first rotation cycle, the intermediate transfer surface 946 can be applied to the print drum 948 and in a second rotation cycle, the applicator assembly 950 can disengage from the print drum 948 and the printhead 942 can emit drops 944 of ink onto the intermediate transfer surface 946. In another embodiment, the applicator assembly 950 can precede the printhead 942 in an operational direction of the print drum 948 and both the intermediate transfer surface 946 and the ink 944 can be applied to the print drum 948 in one cycle.

The printing mechanism 911 can further include a substrate guide 961 and a media preheater 962 that guides a print media substrate 964, such as paper, through a nip 965, formed between opposing actuated surfaces of a roller 968, such as the pressure roll 370, and the intermediate transfer surface 946 supported by the print drum 948. Stripper fingers or a stripper edge 969 can be movably mounted to assist in removing the print medium substrate 964 from the intermediate transfer surface 946 after an image 960 comprising deposited ink drops is transferred to the print medium substrate 964.

A print controller 970 can be operatively connected to the printhead 942. The print controller 970 can transmit activation signals to the printhead 942 to cause selected individual drop generators of the printhead 942 to eject drops of ink 944. The activation signals can energize individual drop generators of the printhead 942.

Figure 4:
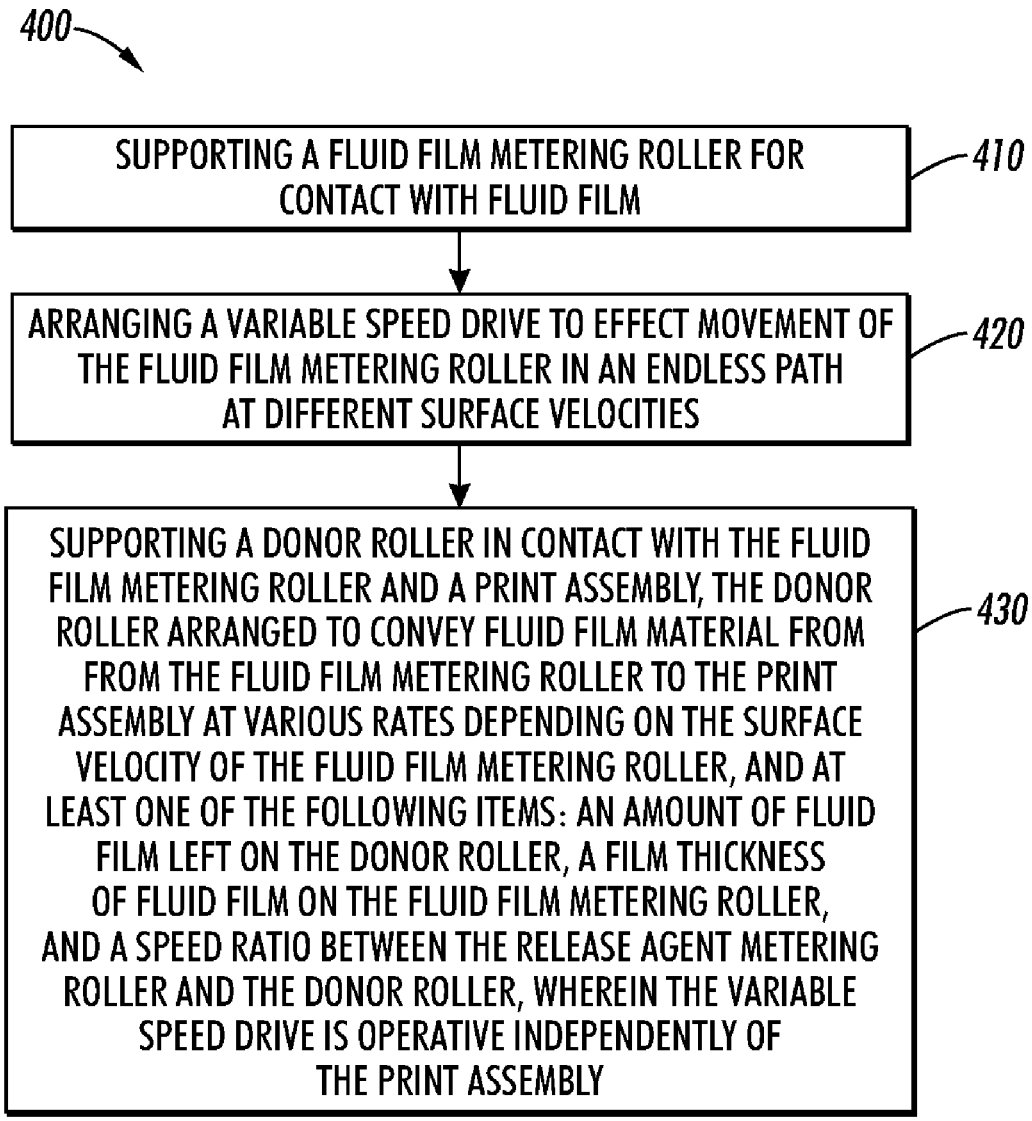
FIG. 4 schematically illustrates a particular example of various illustrative embodiments of a method in accord with the present disclosure.

FIG. 4 schematically illustrates a particular example of various illustrative embodiments of a method 500 useful for variable rate fluid film application in an ink jet printer, in accord with the present disclosure. The method 400 includes supporting the fluid film metering roller 320 for contact with fluid film 315, as shown at 410. The method 400 includes arranging the variable speed drive 330 to effect movement of the fluid film metering roller 320 in an endless path at different surface velocities, as shown at 420. The method 400 also includes supporting the donor roller 340 in contact with the fluid film metering roller 320 and the printing assembly 350, the donor roller 340 arranged to convey fluid film 315 from the fluid film metering roller 320 to the printing assembly 350 at various rates depending on the surface velocity of the fluid film metering roller 320, and at least one of the following items: an amount of fluid film 315 left on the donor roller 340, the film thickness of fluid film 315 on the fluid film metering roller 320, and the speed ratio between the fluid film metering roller 320 and the donor roller 340, wherein the variable speed drive 330 is operative independently of the printer assembly 350, as shown at 430.

Embodiments can provide for an efficient and cost effective way to vary fluid film rate on media while maintaining a good release surface for media on a print assembly and alleviating dependency on metering blade edge quality. In addition, embodiments can provide a robust solution to space constraints in print subsystems and can provide improved methods of controlling and maintaining a uniform fluid film layer on inside and outside paper path areas to minimize image quality artifacts associated with switching media size.

In accordance with the present disclosure, an apparatus, system, and method useful for variable fluid film application in an ink jet printer are disclosed. In various aspects, an apparatus in accordance with the present disclosure may include means for variable rate fluid film application and means for enabling the means for variable rate fluid film application, both the means for variable rate fluid film application and the means for enabling the means for variable rate fluid film application covering corresponding structures and/or materials described herein and equivalents thereof.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. An apparatus useful in ink jet printing comprising:

a source of fluid film;

a fluid film metering roller supported for contact with the source of fluid film;

a variable speed drive arranged to effect movement of the fluid film metering roller in an endless path at different surface velocities; and a donor roller supported in contact with the fluid film metering roller;

an ink jet printhead configured to emit ink; and a print assembly rotatably supported in the apparatus, the print assembly having a print assembly surface coupled to the donor roller, the print assembly configured to receive ink from the ink jet printhead and produce an image on media using the ink, wherein the donor roller is configured to convey the fluid film from the fluid film metering roller to the print assembly surface at various rates depending on a surface velocity of the fluid film metering roller, and at least one of the following: an amount of fluid film left on the donor roller, a film thickness of the fluid film on the fluid film metering roller, and a speed ratio between the fluid film metering roller and the donor roller, wherein the variable speed drive is operative independently of the print assembly.

2. The apparatus of claim 1, wherein the donor roller is elastomer covered.

3. The apparatus of claim 1, wherein the donor roller is driven by the print assembly.

4. The apparatus of claim 2, wherein the donor roller is driven by the print assembly.

5. The apparatus of claim 1, wherein the donor roller slips relative to the fluid film metering roller.

6. The apparatus of claim 2, wherein the donor roller slips relative to the fluid film metering roller.

7. The apparatus of claim 3, wherein the donor roller slips relative to the fluid film metering roller.

8. The apparatus of claim 4, wherein the donor roller slips relative to the fluid film metering roller.

9. The apparatus of claim 1, wherein the fluid film metering roller comprises a material including metal, plastic, aluminum, or ceramic, wherein the material has a surface that is ground, extruded, molded, or turned.

10. The apparatus of claim 8, wherein the fluid film metering roller comprises a material including metal, plastic, aluminum, or ceramic, wherein the material has a surface that is ground, extruded, molded, or turned.

11. A method for variable rate fluid film application in an ink jet printer, comprising:

supporting a fluid film metering roller for contact with a supply of fluid film;

arranging a variable speed drive to effect movement of the fluid film metering roller in an endless path at different surface velocities; and supporting a donor roll in contact with the fluid film metering roller and a print assembly, the donor roller arranged to convey the fluid film from the fluid film metering roller to the print assembly at various rates depending on a surface velocity of the fluid film metering roller, and at least one of the following: an amount of fluid film left on the donor roller, a film thickness of the fluid film on the fluid film metering roller, and a speed ratio between the fluid film metering roller and the donor roller, wherein the variable speed drive is operative independently of the print assembly.

12. The method of claim 11, wherein the donor roller is elastomer covered.

13. The method of claim 12, wherein the donor roller is driven by the print assembly.

14. The method of claim 11, wherein the donor roller is driven by the print assembly.

15. The method of claim 11, wherein the donor roller slips relative to the fluid film metering roller.

16. The method of claim 12, wherein the donor roller slips relative to the fluid film metering roller.

17. The method of claim 13, wherein the donor roller slips relative to the fluid film metering roller.

18. The method of claim 14, wherein the donor roller slips relative to the fluid film metering roller.

19. The method of claim 11, wherein the fluid film metering roller comprises a material including metal, plastic, aluminum, or ceramic, wherein the material has a surface that is ground, extruded, molded, or turned.

20. A system for variable rate fluid film application in an ink jet printer, the system comprising:

a fluid film metering roller supported for contact with a supply of fluid film;

a variable speed drive arranged to effect movement of the fluid film metering roller in an endless path at different surface velocities;

a donor roller supported in contact with the fluid film metering roller and a print assembly, the donor roller arranged to convey fluid film from the fluid film metering roller to the printer assembly at various rates depending on a surface velocity of the fluid film metering roller, and at least one of the following: an amount of fluid film left on the donor roller, a film thickness of fluid film on the fluid film metering roller, and a speed ratio between the fluid film metering roller and the donor roller, wherein the variable speed drive is operative independently of the print assembly; and an ink jet printhead configured to emit ink to the print assembly.

* * * * *